US010889431B2

(12) United States Patent
Cobler

(10) Patent No.: US 10,889,431 B2
(45) **Date of Patent: *Jan. 12, 2021**

(54) SCENTED DRAWSTRING BAG

(71) Applicant: Poly-America, L.P., Grand Prairie, TX (US)

(72) Inventor: Brad A. Cobler, Irving, TX (US)

(73) Assignee: Poly-America, L.P., Grand Prairie, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/892,863

(22) Filed: Jun. 4, 2020

(65) Prior Publication Data

US 2020/0299059 A1 Sep. 24, 2020

Related U.S. Application Data

(63) Continuation of application No. 16/256,609, filed on Jan. 24, 2019, now Pat. No. 10,710,797, which is a continuation of application No. 15/659,868, filed on Jul. 26, 2017, now Pat. No. 10,233,016, which is a continuation of application No. 15/187,914, filed on Jun. 21, 2016, now Pat. No. 9,745,126.

(51) Int. Cl.
*B65F 1/00* (2006.01)
*B65D 33/28* (2006.01)

(52) U.S. Cl.
CPC ..... *B65F 1/0026* (2013.01); *B65D 33/28* (2013.01); *B65F 1/002* (2013.01); *B65D 2203/12* (2013.01); *B65F 2210/129* (2013.01); *B65F 2250/114* (2013.01)

(58) Field of Classification Search
CPC .. B65F 1/0026; B65F 1/002; B65F 2210/129; B65F 2250/114; B65D 33/28; B65D 2203/12
USPC ..... 383/61.4, 75
See application file for complete search history.

(56) References Cited

U.S. PATENT DOCUMENTS

| | | | | |
|---|---|---|---|---|
| 8,657,495 | B2 * | 2/2014 | Maxwell | B65D 33/28 383/75 |
| 8,877,307 | B2 * | 11/2014 | Hall | B65F 1/0006 428/35.7 |
| 9,315,319 | B2 * | 4/2016 | Maxwell | B65F 1/0006 |
| 9,387,957 | B2 * | 7/2016 | Fraser | B65F 1/0006 |
| 9,745,126 | B1 * | 8/2017 | Cobler | B65F 1/0026 |
| 10,233,016 | B2 * | 3/2019 | Cobler | B65F 1/0026 |
| 10,479,600 | B2 * | 11/2019 | Bolos | B65F 1/062 |

(Continued)

FOREIGN PATENT DOCUMENTS

| | | | | |
|---|---|---|---|---|
| FR | 2858809 A1 * | 2/2005 | | B65F 1/0006 |

OTHER PUBLICATIONS

Machine translation of FR-2858809-A1.*

*Primary Examiner* — Jes F Pascua
(74) *Attorney, Agent, or Firm* — Daniel J. Layden; Brandon J. Lee

(57) ABSTRACT

The present invention is directed to a thermoplastic bag comprised of a front panel and a back panel. The front panel and back panel are generally joined along a first side edge, a second side edge, and a bottom edge of the respective front panel and back panel. The front panel has a distal edge with the distal edge folded over the front panel to provide a hem and an overlap area immediately below the first hem. The overlap encapsulates a scent carrier that can provide a scent to the thermoplastic bag.

19 Claims, 12 Drawing Sheets

(56) References Cited

U.S. PATENT DOCUMENTS

Figure 1:
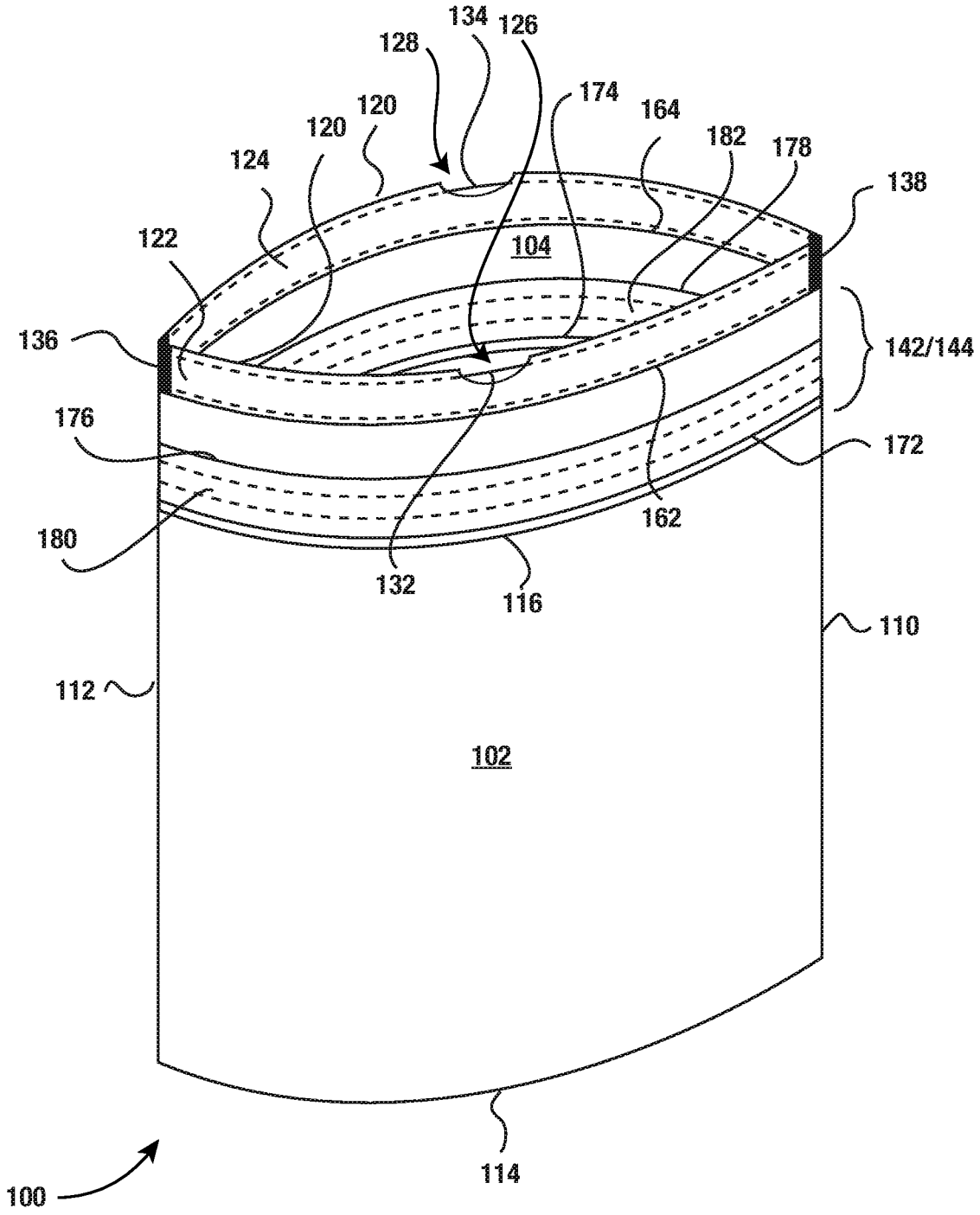

| | | | | |
|---|---|---|---|---|
| 10,549,888 | B2 * | 2/2020 | Jean-Mary | B65F 1/0026 |
| 10,710,797 | B2 * | 7/2020 | Cobler | B65F 1/002 |
| 2003/0223657 | A1 * | 12/2003 | Belias | B65D 31/04 383/105 |
| 2011/0164834 | A1 * | 7/2011 | Stiglic | B65F 1/0026 383/75 |
| 2013/0044966 | A1 * | 2/2013 | Binger | B65D 33/28 383/105 |
| 2017/0008261 | A1 * | 1/2017 | Jean-Mary | B32B 27/32 |
| 2017/0305662 | A1 * | 10/2017 | Bolos | A61L 9/12 |
| 2018/0118415 | A1 * | 5/2018 | Jean-Mary | B65F 1/0026 |
| 2020/0115112 | A1 * | 4/2020 | Jean-Mary | B65D 33/28 |

* cited by examiner

SCENTED DRAWSTRING BAG

CROSS-REFERENCE TO RELATED APPLICATIONS

The present application is a continuation of U.S. patent application Ser. No. 16/256,609, filed Jan. 24, 2019, which is a continuation of U.S. patent application Ser. No. 15/659,868, filed Jul. 26, 2017, now U.S. Pat. No. 10,233,016, issued Mar. 19, 2019, which is a continuation of U.S. patent application Ser. No. 15/187,914, filed Jun. 21, 2016, now U.S. Pat. No. 9,745,126, issued Aug. 29, 2017. These three aforementioned applications are incorporated by reference in their entirety into this application.

BACKGROUND OF THE INVENTION

1. Field of the Invention

The present invention relates to improvements in the construction and manufacture of polymeric bags. In particular, the present invention relates to improvements to scented trash bags.

2. Description of the Related Art

Polymeric bags are ubiquitous in modern society and are available in countless combinations of varying capacities, thicknesses, dimensions, and colors. The bags are available for numerous applications including typical consumer applications such as long-term storage, food storage, and trash collection. Like many other consumer products, increased demand and new technology have driven innovations in polymeric bags improving the utility and performance of such bags. The present invention is an innovation of particular relevance to polymeric bags used for trash collection.

Polymeric bags are manufactured from polymeric film produced using one of several manufacturing techniques well-known in the art. The two most common methods for manufacture of polymeric films are blown-film extrusion and cast-film extrusion. In blown-film extrusion the resulting film is tubular while cast-film extrusion produces a generally planar film. Regardless of the manufacturing method utilized, the present invention is generally applicable to drawstring trash bags typically manufactured from a continuous web of plastic film. Manufacturing methods for the production of drawstring bags from a web of material are shown in numerous prior art references including, but not limited to, U.S. Pat. Nos. 3,196,757 and 4,624,654, which are hereby incorporated by reference.

Modern trash bags are commonly sold and marketed with a scent or fragrance incorporated into the bag. In fact, scented bags have seen an increase in popularity. Typically, the scent is incorporated into the bag during the extrusion process in the manufacturing of the polymeric film. Resin with a concentration of a scent producing volatile oil may be incorporated with unscented resin into a blown film extruder which produces the web of polymeric film that is converted into bags. Thus, the scent or fragrance agent is incorporated throughout the film used to manufacture the trash bags. The scent carrying oil is known to migrate to the surface of the bag once manufacturing of the bag is complete.

One disadvantage of the above-described method of providing a scent or fragrance to trash bags is that a considerable amount of the volatile scent agents may be volatized during the film extrusion process. This requires use of more scent than otherwise would be required and may pose various challenges in the extrusion process. Another disadvantage is that if the resultant scented film is reprocessed or recycled, the end products produced from the reprocessed material may partially retain the scent, which may not be desired for certain end-products which are typically products other than kitchen trash bags. Furthermore, when reprocessed, various scents are combined since recycled materials are intermingled; hence, items produced with the reprocessed material may have undesirable mixtures of various scents and fragrances.

Other solutions have been disclosed by the prior art to provide scent to a thermoplastic bag without incorporating scent through the film of the bag. For instance, United States Published Patent Appl. No. 2009/0175564A1, entitled "Bag with Improved Features" discloses a strip disposed on an inside surface of the bag that can include a scent. However, the bag of this published application exposes the scent strip outside of the bag, failing to prevent a user from coming into contact with the strip and fails to control the release of the volatile scent since the strip is exposed on an external surface of the bag.

Another solution in the prior art is disclosed by United States Published Patent Appl. No. 2009/0026101A1, entitled "Disposable Scent Sanitary Bag." This published application discloses a drawstring bag with a scent strip located on an interior side of a panel of the bag below the bag's drawstring. As with the solution discussed above, the bag of this disclosure exposes the scent carrying element and thus has some of the same inherit disadvantages.

In light of the foregoing, it would be desirable to provide a means for imparting a scent to trash bags by other means than incorporating it into the polymeric film during the extrusion of the polymer. It would further be desirable to provide a solution that encloses the scent element while still providing adequate scent to a user of the bag. The present invention represents a novel solution to address these needs.

SUMMARY OF THE INVENTION

In at least one embodiment of the present invention, a thermoplastic bag has a front panel and a back panel. The front panel and back panel can be joined at a bottom edge defined by a fold in the single piece of thermoplastic film. The front panel and back panel can be joined by a first side seal generally along a first side edge and by a second side seal generally along a second side edge. A front folded over upper portion of the front panel can define a first upper edge and the first upper edge can define an upper opening of the thermoplastic bag. A distal edge of the front folded over upper portion can be affixed to the front panel by a first lower seal. The first lower seal can extend generally between the first side edge and the second side edge. A first hem seal can be below the first upper edge and above the first lower seal. The first hem seal can extend generally between the first side edge and the second side edge. A first drawstring can be between the front folded over upper portion and the front panel. The first drawstring can also be below the first upper edge and above the first hem seal. The first drawstring can extend generally between the first side edge and the second side edge. A first scent carrier can be between the front folded over upper portion and the front panel. The first scent carrier can also be below the first hem seal and above the first lower seal. The first scent carrier can extend generally between the first side edge and the second side edge. The first scent carrier may be separated a distance from the first and second side seals.

In certain embodiments of the present invention, the first scent carrier may comprise a bead of a low melt temperature polymer. The low melt temperature polymer may have a contrasting color from the first drawstring and the film of the thermoplastic bag. In an alternative embodiment, the first scent carrier may comprise a first ribbon of polymeric film. The first ribbon of polymeric film may further comprise a polymeric resin impregnated with scent. In a further alternative embodiment, at least one surface of the first ribbon of polymeric film may be coated with a liquid scent compound. The liquid scent compound may be applied to the first ribbon by a roller, brush, or spray. Additionally, the first ribbon may comprise a contrasting color from the first drawstring and the polymeric film of the thermoplastic bag. The first scent ribbon may be affixed proximate to the first side edge and the second side edge. The first scent ribbon may be sealed to the front panel by a seal extending between the first and second side edges. The first scent ribbon may further be inaccessible to a user of the polymeric bag.

In at least certain embodiments of the present invention, a plurality of slits may be formed in the polymeric film of the first panel between the first hem seal and the first lower seal. In an alternative embodiment, a plurality of ventilation apertures in the polymeric film of the first panel may be formed between the first hem seal and the first lower seal. The first scent carrier may also have a contrasting color between the first drawstring and the front and rear panels. In a further embodiment of the invention, an interior of the polymeric bag may be coated with a liquid scent between the front and rear panels. The liquid scent may be located closer to the bottom edge than the first upper edge. In another embodiment of the invention, a first intermediate seal may be located between the first hem seal and the first lower seal. The first intermediate seal may extend between the first side edge and the second side edge. The first scent carrier may be located between the first intermediate seal and the first lower seal. In an alternative embodiment, the first scent carrier may be located between the first hem seal and the first intermediate seal.

In a further alternative embodiment, a first scented adhesive may be located between the front folded over upper portion and the front panel. The first scented adhesive may further be located below the first hem seal and above the first lower seal. The first scented adhesive may extend between the first side edge and the second side edge and adhere the front folded over portion to the front panel of the drawstring trash bag.

BRIEF DESCRIPTION OF THE RELATED DRAWINGS

A full and complete understanding of the present invention may be obtained by reference to the detailed description of the present invention and certain embodiments when viewed with reference to the accompanying drawings. The drawings can be briefly described as follows.

FIG. 1 provides a perspective view of a first embodiment of the present invention.

Figure 2:
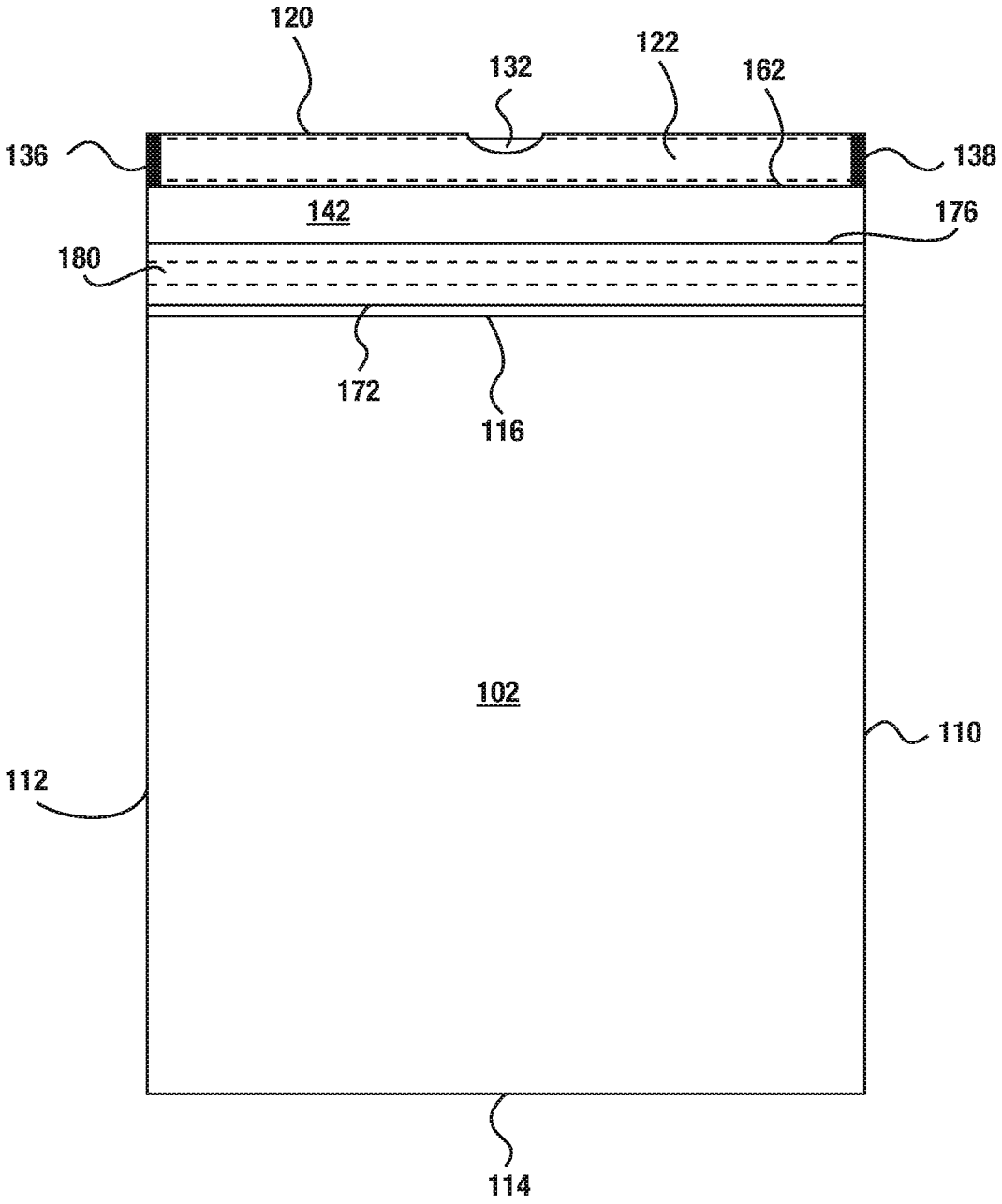

FIG. 2 provides an elevation view of the front panel according to the first embodiment.

Figure 3:
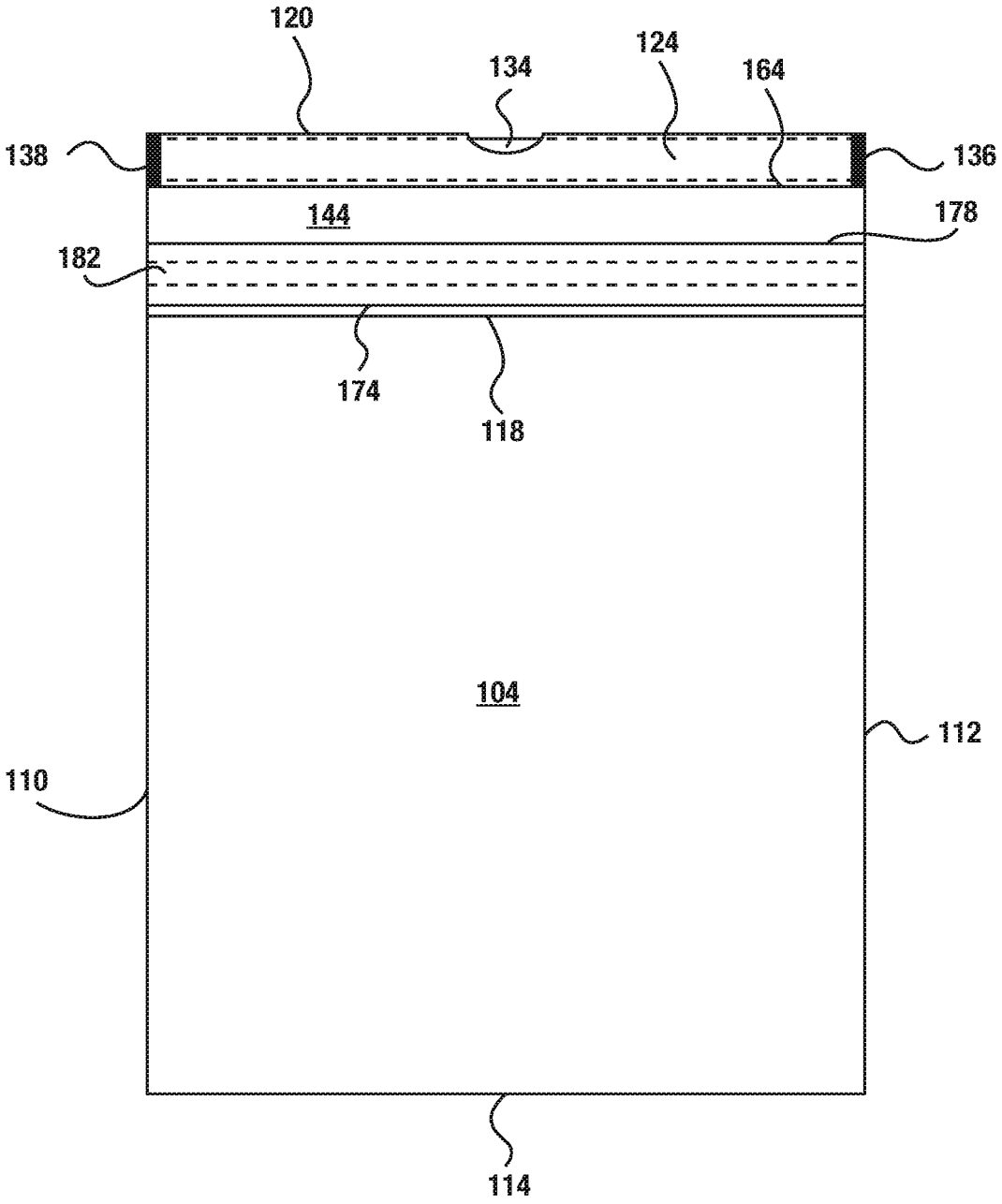

FIG. 3 provides an elevation view of the back panel according to the first embodiment.

Figure 4A:
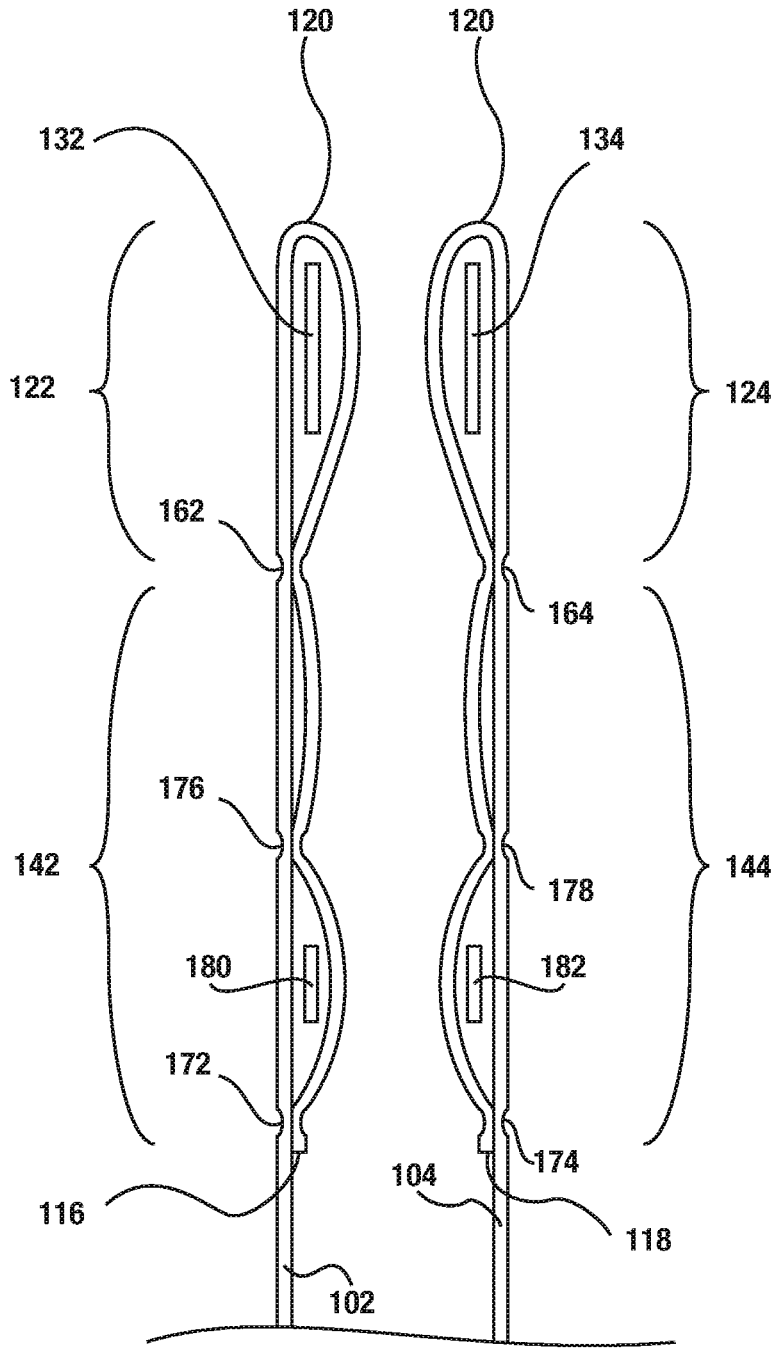

FIG. 4*a* provides a cross sectional partial upper view of the first embodiment.

Figure 4B:
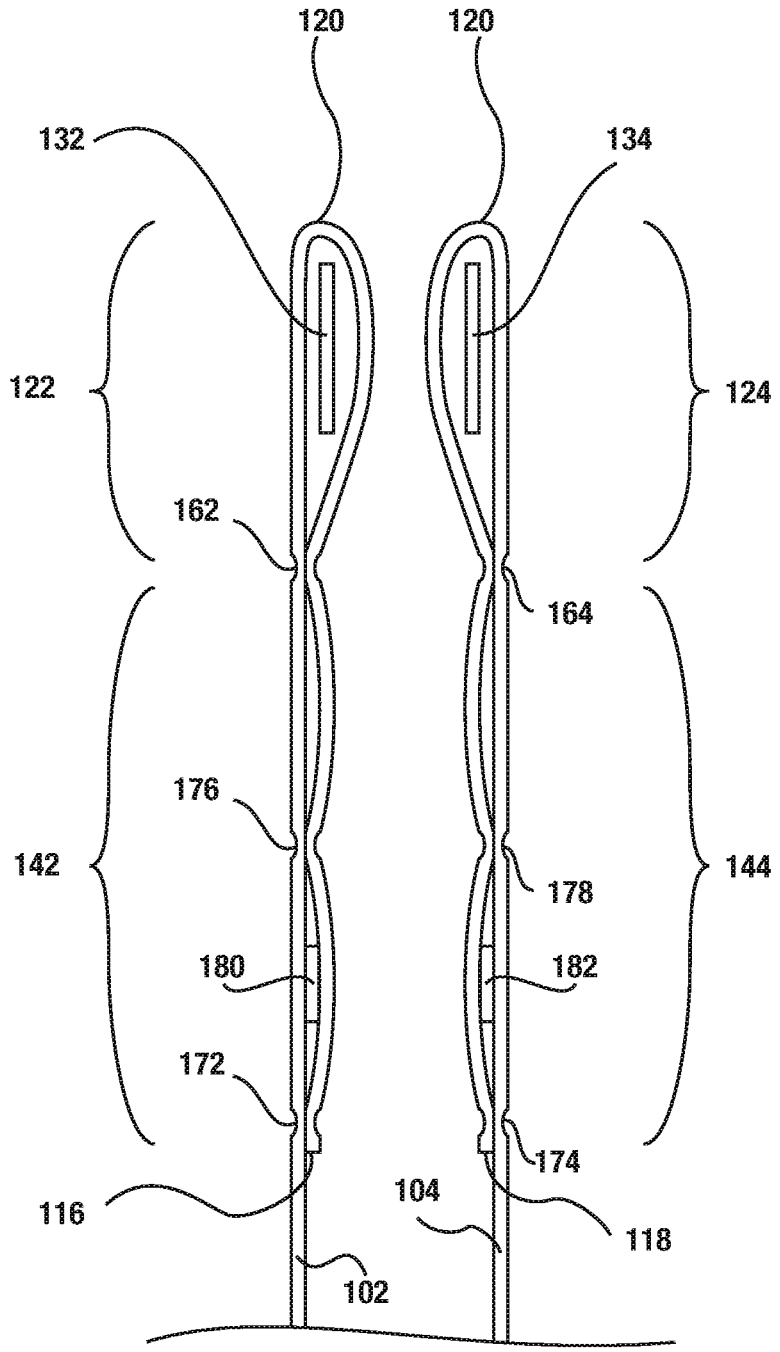

FIG. 4*b* provides a cross sectional partial upper view of a second embodiment of the present invention.

Figure 4C:
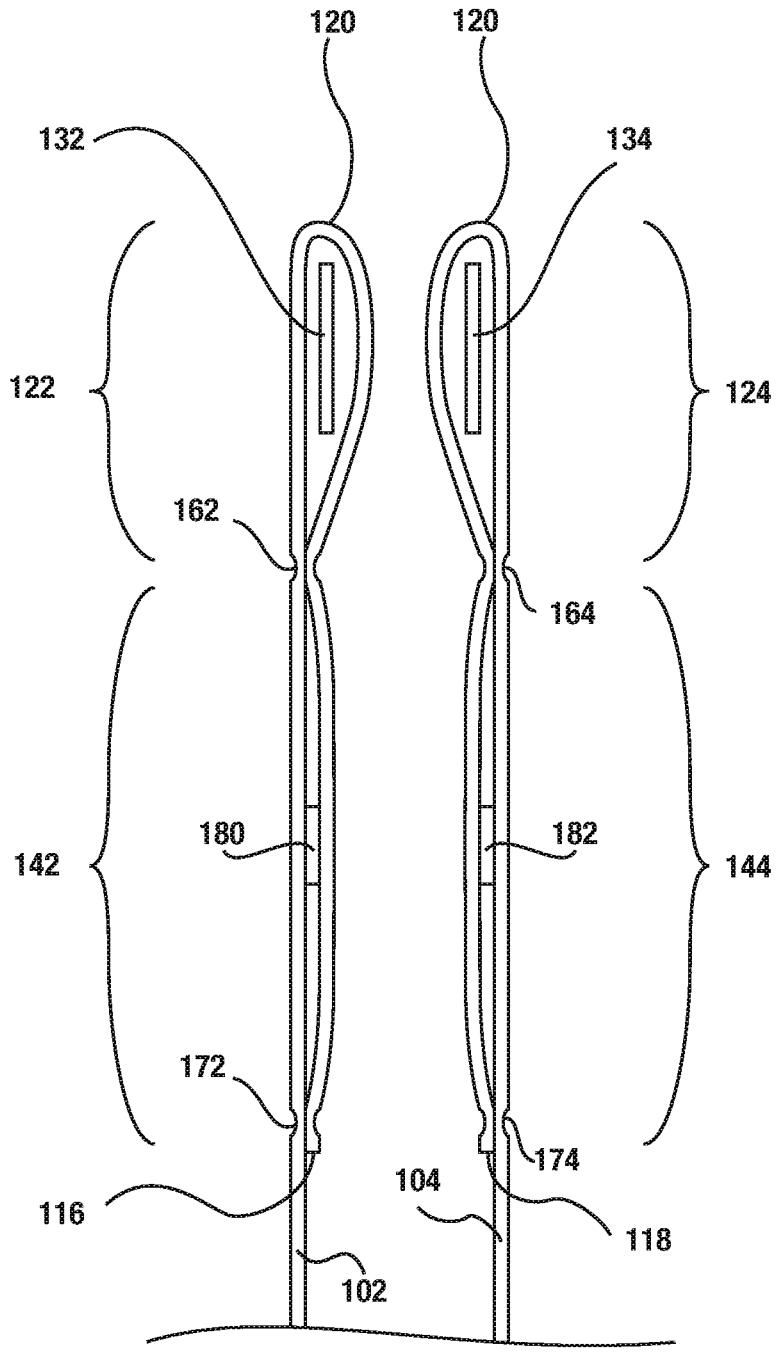

FIG. 4*c* provides a cross sectional partial upper view of a third embodiment of the present invention.

Figure 5:
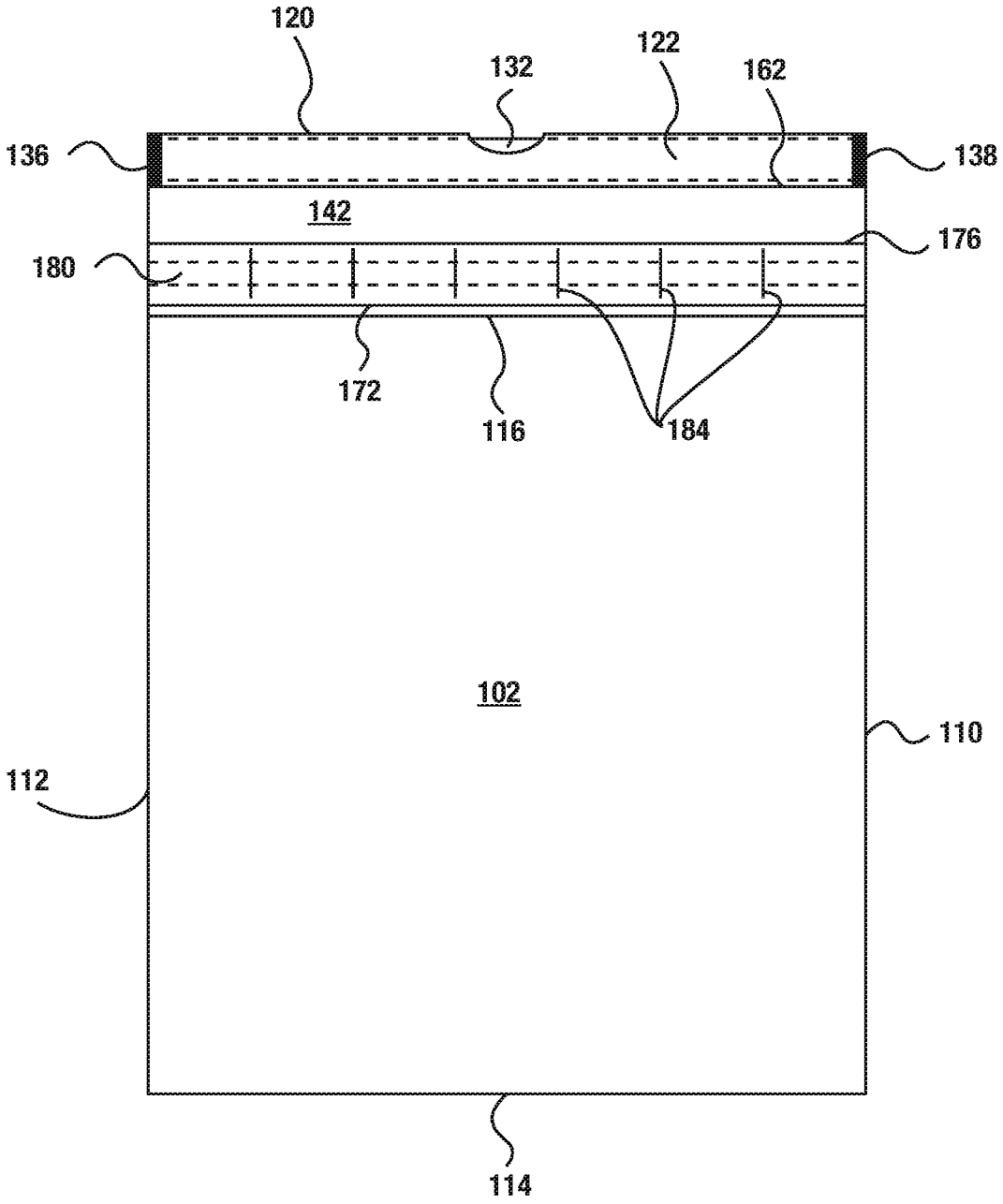

FIG. 5 provides an elevation view of a fourth embodiment of the present invention.

Figure 6A:
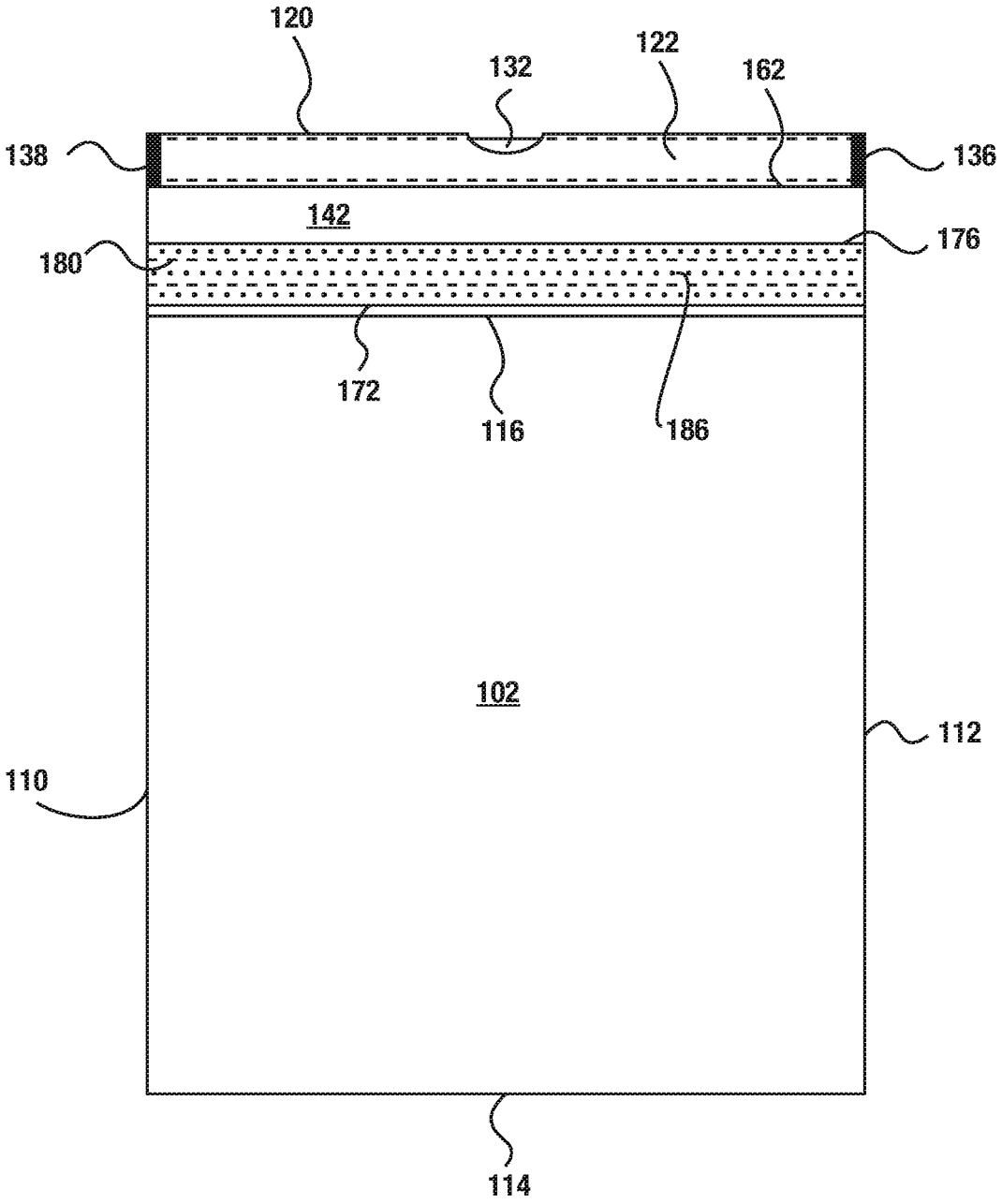

FIG. 6*a* provides an elevation view of a fifth embodiment of the present invention.

Figure 6B:
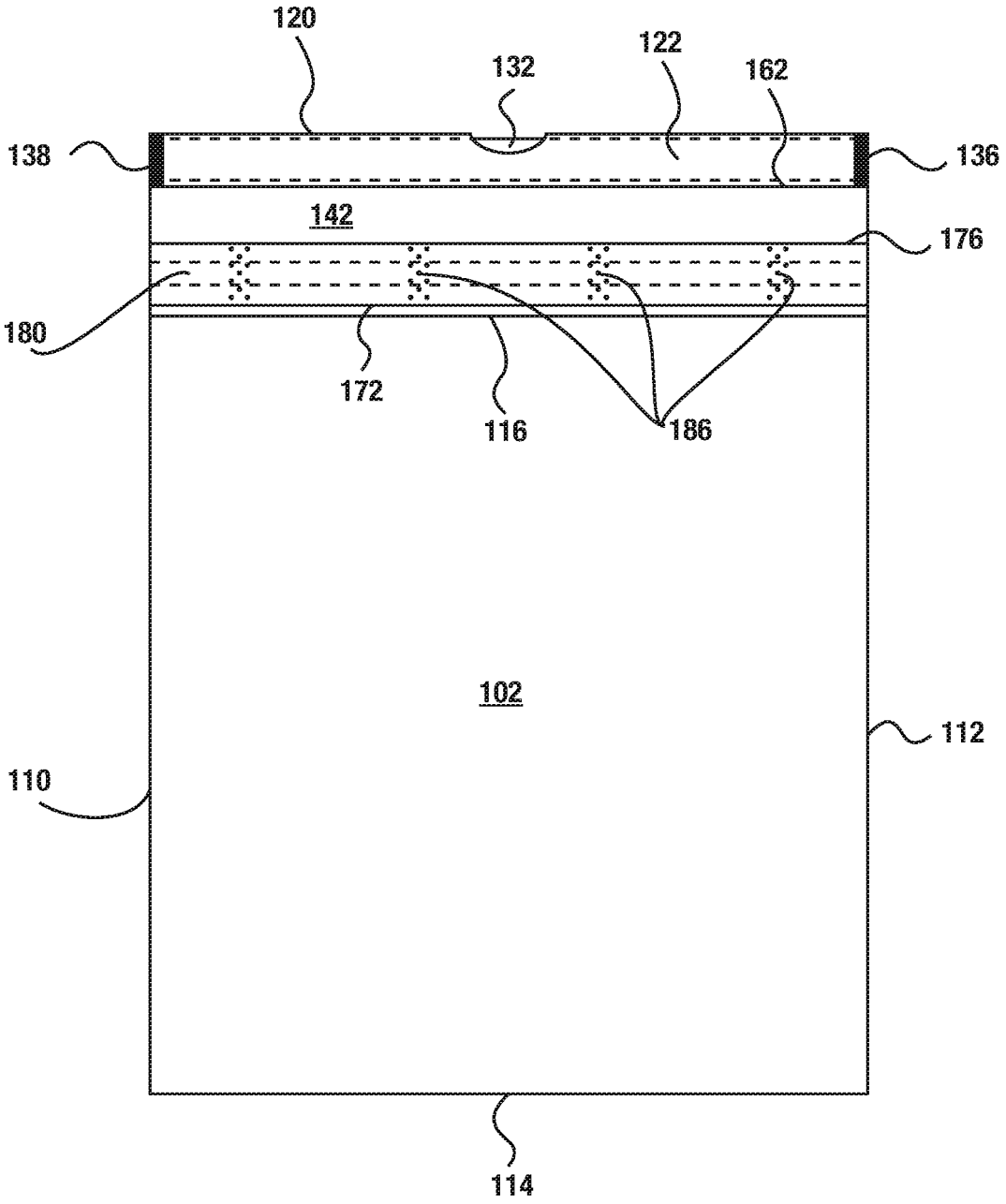

FIG. 6*b* provides an elevation view of a sixth embodiment of the present invention.

Figure 7:
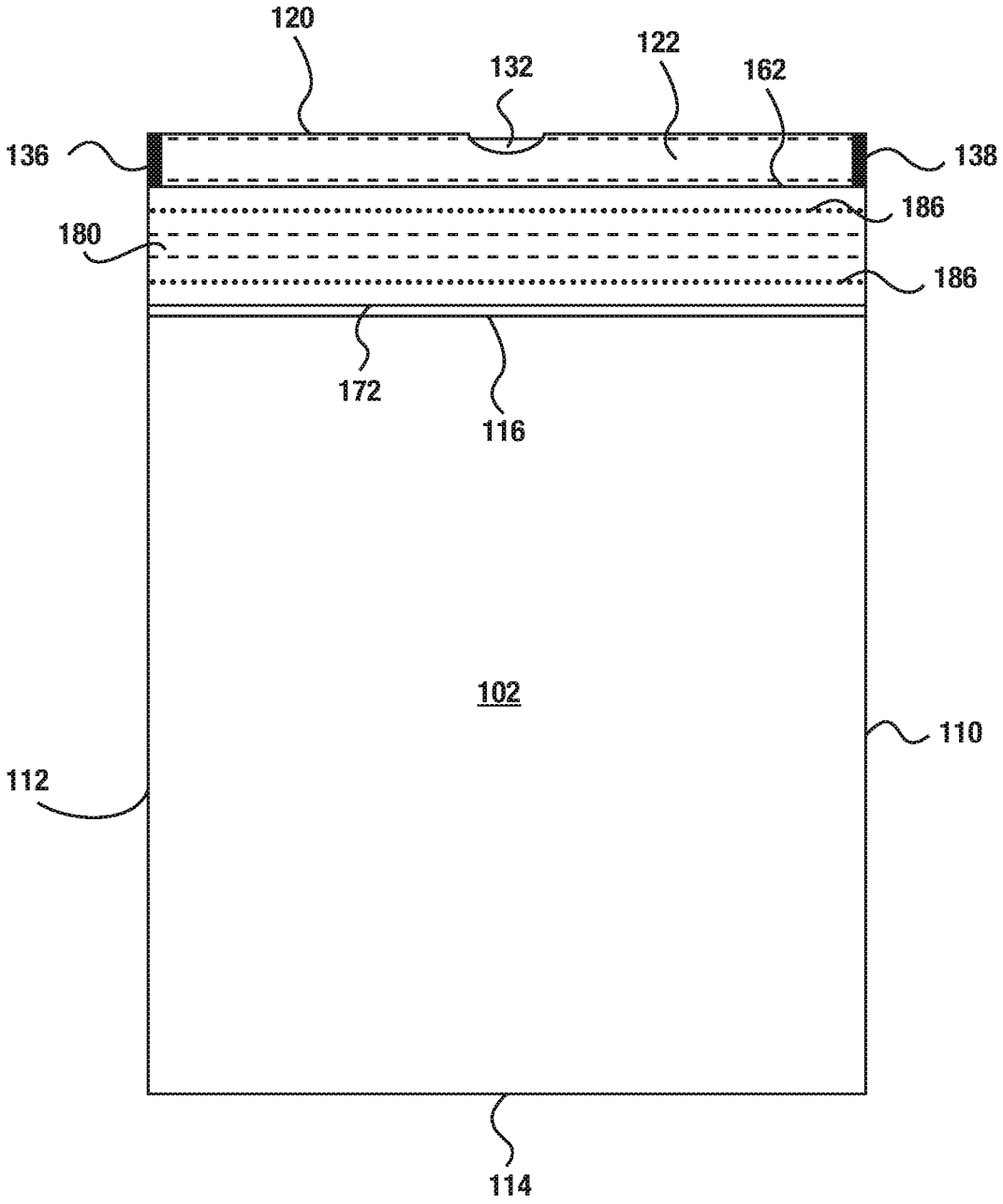

FIG. 7 provides an elevation view of a seventh embodiment of the present invention.

Figure 8A:
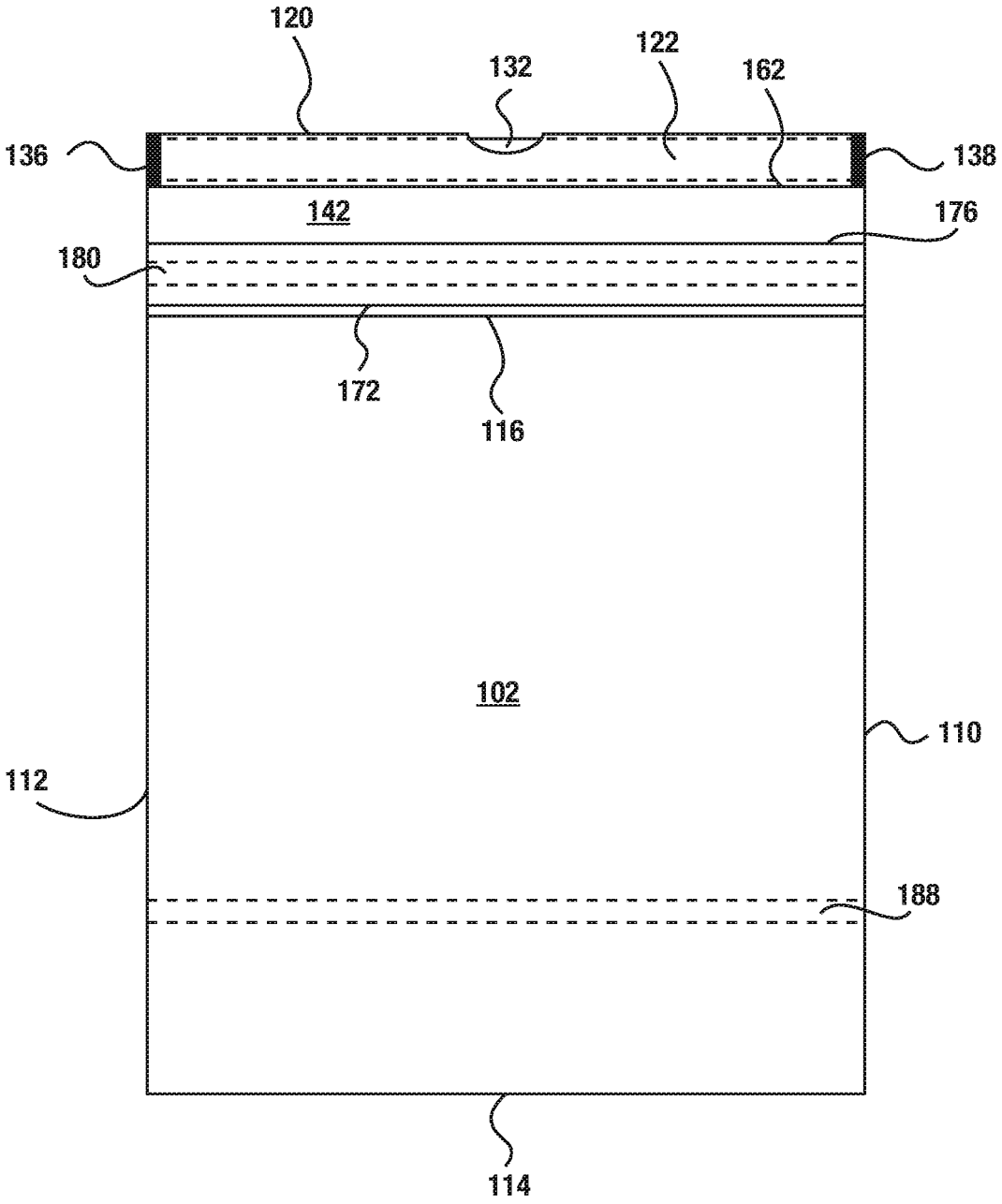

FIG. 8*a* provides an elevation view of an eighth embodiment of the present invention.

Figure 8B:
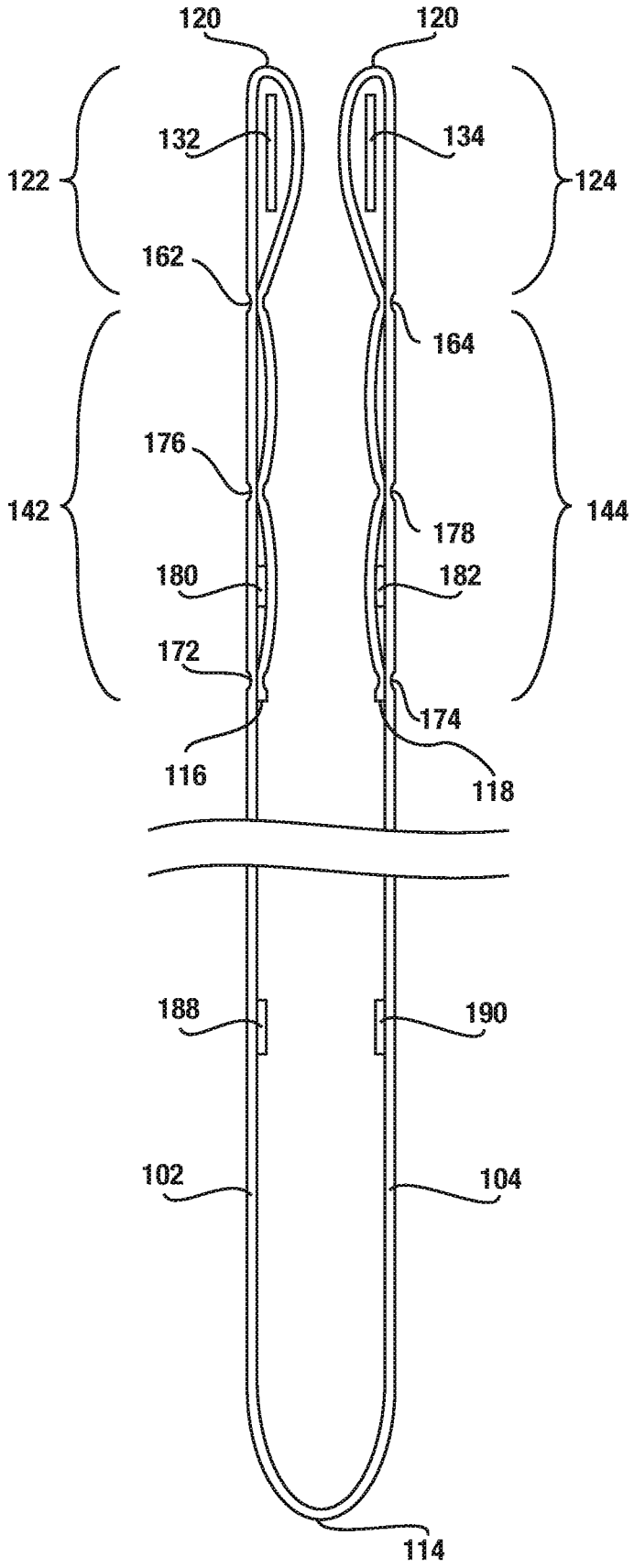

FIG. 8*b* provides a cross sectional view of the eighth embodiment.

DETAILED DESCRIPTION OF THE INVENTION

The present disclosure illustrates several embodiments of the present invention. It is not intended to provide an illustration or encompass all embodiments contemplated by the present invention. In view of the disclosure of the present invention contained herein, a person having ordinary skill in the art will recognize that innumerable modifications and insubstantial changes may be incorporated or otherwise included within the present invention without diverging from the spirit of the invention. Therefore, it is understood that the present invention is not limited to those embodiments disclosed herein. The appended claims are intended to more fully and accurately encompass the invention to the fullest extent possible, but it is fully appreciated that certain limitations on the use of particular terms are not intended to conclusively limit the scope of protection.

FIG. 1 provides a perspective view of a first embodiment of the present invention while FIG. 2 and FIG. 3 show a front and rear elevation of the same embodiment. Looking collectively at FIGS. 1-3, a drawstring trash bag 100 according to one embodiment is comprised of a front panel 102 and a back panel 104, the front panel 102 and back panel 104 being substantially rectangular in shape and joined along a first side edge 110, a second side edge 112, and a bottom edge 114 to provide the body of the bag. The front panel 102 and back panel 104 may be formed from a single piece of polymeric film which is folded to define the bottom edge 114 and subsequently sealed along the first side edge 110 and second side edge 112 by corresponding first and second side seals. Other manufacturing configurations may also be utilized in conjunction with the present invention.

In certain embodiments, the front panel 102 and the back panel 104 are formed by plastic films that are substantially uniform in thickness, subject to standard manufacturing tolerances and variations, with an average thickness of between 0.4 mils and 4 mils for each panel 102, 104. Moreover, in some embodiments, the average thickness of each of the respective panels 102, 104 is between 0.6 mils and 1.0 mils. Moreover, in certain preferred embodiments, the average thickness of each of the respective panels 102, 104 is between 0.75 mils and 1.0 mils.

In certain embodiments of the present invention, including the embodiment depicted in FIG. 1, the front panel 102 and back panel 104 of the drawstring trash bag 100 are comprised of a polymer blend, the polymer blend generally having linear low density polyethylene (LLDPE) as the primary component, but other polymers may be utilized including, but not limited to, other polyethylenes such as high density polyethylene (HDPE) or low density polyethylene (LDPE). Typically, the primary component of the polymer blend, such as linear low density polyethylene (LLDPE), will comprise at least 75% of the polymer blend. The remaining portion of the polymer blend may include additives including, but not limited to, coloring additives, anti-blocking agents, and/or odor control additives.

Looking briefly at FIG. 4*a*, a cross sectional view of one embodiment of the present invention, better illustrates certain aspects, features, and advantages of the present invention. In particular, an upper cross-section of a drawstring trash bag 100 is depicted. The thicknesses and certain dimensions are exaggerated in FIG. 4*a* and in further cross-sectional views to better illustrate the relation between the various parts of the embodiments. During manufacture of the drawstring trash bag, the distal edge 116 of the front panel 102, i.e. the edge of the folded-over portion of the front panel 102 results from the fold-over portion defining a first hem 122 in the front panel 102 with a first drawstring 132 disposed within the first hem 122. Similarly, the distal edge 118 of the back panel 104 results from the fold-over portion defining the second hem 124 with a second drawstring 134 disposed in the second hem 124. The upper boundaries of the hems 122, 124 define the upper opening 120 of the drawstring trash bag 100.

The drawstrings 132, 134 may be comprised of traditional high-density polyethylene drawstrings or, in some embodiments, elastic or elastic-like polymeric components. The drawstrings 132, 134 are anchored to the front panel 102 and back panel 104 at the ends of the respective drawstrings 132, 134 near the first side edge 110 and second side edge 112. In particular, the drawstrings 132, 134 are commonly anchored using short seals 136, 138 as shown in FIGS. 1-3, the short seals 136, 138 fusing both drawstrings 132, 134 with both the front panel 102 and the back panel 104. Other than the anchor point, the drawstrings 132, 134 are generally loose within the hems 122, 124 enabling the drawstrings 132, 134 to be accessed and pulled through the respective drawstring cutouts 126, 128 centrally located between the first side edge 110 and second side edge 112. Consequently, when the drawstrings 132, 134 are pulled through the drawstring cutouts 126, 128 of the drawstring trash bag 100, the respective upper corners of the drawstring trash bag 100 are pulled together to facilitate closure of the bag.

Now once again examining FIGS. 1-4*a*, according to the depicted embodiment of the present invention, the distal edges 116, 118 of the respective front and back panels 102, 104 are located a distance below the respective hems 122, 124. Thus, the front panel 102 has an overlap area 142 that extends from the lower boundary of the first hem 122 to the distal edge 116 of the front panel 102. In the same manner, the back panel 104 has an overlap area 144 that extends from the lower boundary of the second hem 124 to the distal edge 118 of the back panel 104. Thus, for the front panel 102, the overlap area 142 comprises two layers of polymeric film, and the hem overlap area 144 of the back panel 104 also comprises two layers of polymeric film according to the depicted embodiment. The length of the first overlap area 142 and the second overlap area 144 can be selected to be any length including a distance ending only slightly below the bottom boundaries of the respective hems 122, 124 or a distance that extends nearly to the bottom of the bag. However, in certain embodiments, it is desirable to provide a first overlap area 142 or second overlap area 144 of between 1 inch and 12 inches with a preferred range of 1.5 inches to 8 inches.

The depicted embodiment of FIGS. 1-4*a* further shows hem seals 162, 164 extending the width of the drawstring trash bag 100. Additionally, lower seals 172, 174 are provided in the respective panels 102, 104 proximate to the respective distal edges 116, 118. Intermediate seals 176, 178 may further be provided between the hem seals 162, 164 and the lower seals 172, 174. By providing hem seals 162, 164 near the top of the overlap areas 142, 144, lower seals 172, 174 near the bottom of the overlap areas 142, 144, and intermediate seals between the hem and lower seals, the two layers of plastic film comprising each overlap area 142, 144 are kept in close proximity, providing effectively a two-ply polymeric film of double thickness in the region of the overlap areas 142, 144. For example, in the case of a front panel 102 and back panel 104 each having a nominal thickness of 0.7 mil, the overlap areas 142, 144 provide a thickness of roughly 1.4 mils.

The overlap areas 142, 144 as shown in the depicted embodiments provide a location to place scent carriers 180, 182 in the drawstring trash bag 100 as further shown in FIGS. 1-4*a*. A first scent carrier 180 can be placed in the first overlap area 142 of the front panel 102 and a second scent carrier 182 can be placed in second overlap area 144 of the back panel 104. Scent carriers 180, 182 can be between intermediate seals 176, 178 and lower seals 172, 174 as shown by FIGS. 1-4*a*. In an alternative embodiment, scent carriers 180, 182 can be between hem seals 162, 164 and intermediate seals 176, 178. In a further alternative embodiment, intermediate seals 176, 178 can be absent from the bag 100 and scent carriers 180, 182 can be placed between hem seals 162, 164 and lower seals 172, 174. As shown in FIG. 4*a*, scent carriers 180, 182 are shown in both overlap areas 142, 144; however, in certain embodiments, a single scent carrier may only be placed in one of the overlap areas.

Scent carriers 180, 182 can have a contrasting color from the drawstrings 132, 134 and film of bag 100. Different colors for scent carriers 180, 182 may also be used to distinguish between different scents applied to scent carriers 180, 182.

Enclosing scent carriers 180, 182 within the first and second overlap areas 142, 144 can provide a scent to drawstring trash bag 100 with the use of a scent agent or scent compound. The scent agent or compound can be a commercially available volatile liquid scent oil. The scent agent, in the alternative, may be compounded into a polymeric resin. A scented resin may be sourced from a commercial supplier and blended with non-scented resins in the extrusion process for the polymeric film of bag 100. Scented polymeric resins and liquid scents are commonly available in various scents/fragrances and concentrations.

Use of scent carriers 180, 182 provides a scent without requiring a scent agent to be incorporated into the polymer of the overall bag such that the scent agent does not interfere with the extrusion process or volatize during the extrusion process for the polymeric film for bag 100. Placing scent carriers within the overlap areas also prevents a user of bag 100 from coming into direct contact with the scent agent. Furthermore, placing the scent agent in this location provides for a controlled release of scent since the scent carriers are encapsulated within the polymeric film of the front and back panels 102, 104. The release of the scent agent from the overlap areas 142, 144 may also be controlled or metered by a limited number of slits or perforations in the overlap areas as illustrated by FIGS. 6*a*, 6*b*, and 7, which are described further in more detail below.

As shown in FIG. 4*a*, in at least one embodiment, the scent carriers 180, 182 can be in the form of scent ribbons 180, 182. Scent ribbons 180, 182 can be long and narrow strips of polymeric film. Scent ribbons 180, 182 in certain embodiments can be affixed to bag 100 at side seals adjacent to first and second side edges 110, 112 and otherwise loosely encapsulated by overlap areas 142, 144. In at least one alternative embodiment, scent ribbons 180, 182 can be affixed to bag 100 by one or more seals along a length of each ribbon.

In certain embodiments of the invention illustrated in FIG. 4*a*, scent ribbons 180, 182 can have a similar width, thickness, and length as drawstrings 132, 134, while in alternative embodiments, the width and thickness of scent ribbons 180, 182 can be greater or lesser than the width and thickness of drawstrings 132, 134. The scent ribbons 180, 182 may also be thinner than a typical drawstring since ribbons 180, 182 do not carry any structural load of the trash bag 100. However, in certain embodiments, the scent ribbons 180, 182 may be thicker than a typical drawstring if the scent agent is incorporated into the polymeric resin of the ribbons. A thicker material will allow for a greater amount of material volume for the scent agent to be incorporated into. In general, in certain embodiments, the scent ribbons may have an approximate width from ½ inch to three inches and a length generally equal to the width of bag 100.

In certain embodiments, the scent agent may be applied to one or more surfaces of the ribbons 180, 182 of FIG. 4*a*. A liquid scent agent may be applied to the surfaces of the ribbons by a roller, brush, sponge, or sprayer. A liquid scent may also be applied to the ribbons by submersing the ribbons into a dip tank. The scent may be applied to the ribbons 180, 182 continuously or intermittently.

If the liquid scent is applied intermittently, the liquid scent may be applied by a registration operation so that no scent is applied at or near the side seals that affix the front and back panels 102, 104 at side edges 112, 114. No liquid scent at or adjacent to the side seals is desirable so that the liquid scent does not interfere with formation of the side seals. The registration operation may rely upon the timing of the formation of the first or second side edges 110, 112 to time appropriately the application of the liquid scent to ribbons 180, 182. A converting process may trigger the application of the liquid scent to the scent ribbons 180, 182 based on when side edges are formed on bag so that the location of the liquid scent on ribbons 180, 182 is synchronized with the location of the side seals.

If a liquid scent is applied to one or more surfaces of the scent ribbons 180, 182 of FIG. 4*a*, the ribbons may be thinner than a typical drawstring to conserve the amount of polymer used in the construction of the ribbons. However, the width of the ribbons 180, 182 may be greater than a typical drawstring to increase the amount of surface area for applying the liquid scent to the one or more surfaces. For instance, scent ribbons 180, 182 can have a width of 2-3 inches but have a thickness as low as 0.5 mils such that each ribbon's surface area is maximized while material utilization is minimized.

In at least one embodiment of a manufacturing process for the drawstring trash bag 100 illustrated by FIG. 4*a*, the scent ribbons 180, 182 and drawstrings 132, 134 can be formed from a single width of polymeric film. The width of the polymeric film can, in general, be the sum of the desired width of the two drawstrings and two ribbons and supplied to a bag converting operation by a single roll stock of polymeric film. Once the roll stock of film is unwound, the film may be split into fractional widths to provide the scent ribbons 180, 182 and the drawstrings 132, 134 from a single width of film. Prior to the converting operation inserting the scent ribbons into the overlap area and the drawstrings into the hems 122, 124, the scent agent may be applied to each ribbon provided from a fractional width of the slit web. The scent agent may be applied to the ribbon section by one of the methods discussed above. Once the scent agent is applied to the scent ribbon, it may be inserted into the overlap area of the polymeric film that forms drawstring trash bag 100.

Shown in FIG. 4*b* is a cross sectional view of a further embodiment of the invention. As shown in FIG. 4*b*, scent carriers 180, 182 may be affixed directly to the corresponding front and back panels 102, 104. In an alternative embodiment, scent carriers 180, 182 may be affixed to the folded-over portions of front and back panels 102, 104. Rather than a polymeric film supplied to bag converting operation from roll stock, the scent carriers 180, 182 can be applied to the overlap areas 142, 144 in a molten state, and placed directly onto the surface of the front and back panels 102 and 104. A bead of molten material can be injected directly onto the surface of the front and back panels 102 and 104 to form scent carriers or scent beads 180, 182. The molten material of scent beads 180, 182 can be a low temperature melting point polymer with a scent agent incorporated into and dispersed throughout the polymer.

For the molten material of scent beads 180, 182 of FIG. 4*b*, a polymer can be selected with an appropriate high melt index such that it may be melted and pumped by a melt pump at a low enough temperature so that the physical properties of the film of trash bag 100 are not substantially degraded. The molten material used may also have a low viscosity and a low molecular weight to aid in heating the material to a molten state and injecting it onto the polymeric film of bag 100. A contrasting color may be added to the molten polymer to communicate to the end user the presence of the scent beads 180*b*, 182*b*. Since typical polymeric films of trash bags have a certain amount of opacity, the user of the bag will be able to view the color. Furthermore, different colors may be used to differentiate between the use of different scent agents, with each scent agent having a distinctive scent or fragrance and a corresponding contrasting color from other scent agents.

Shown in FIG. 4*c* is a cross sectional view of an additional embodiment of the invention. FIG. 4*c* shows scent carriers 180, 182 located between hem seals 162, 164 and lower seals 172, 174 at the same location of the intermediate seals 176, 178 of the previous embodiments. The scent carriers 180, 182 of FIG. 4*c* can be applied as a molten adhesive with a low temperature melt point having a scent agent incorporated throughout the molten adhesive. The scented adhesive can be applied to the front and back panels 102, 104 in the shape of a strip or bead to form scented adhesive strips 180, 182 to function as scent carriers 180, 182. The adhesive can be selected such that it does not degrade substantially the physical properties of polymeric film of bag 100.

The scented adhesive strips 180, 182 of FIG. 4*c* can be applied to the film of front and back panels 102, 104 such that when the folded-over portions of the panels are brought into contact with the panels, the folded-over portion adheres to panels 102, 104. Thus, scented adhesive strips 180, 182 can take the place of intermediate seals 176, 178 in affixing the folded-over portion of the front and back panels to the front and back panels 102, 104. The scented adhesive strips 180, 182 can further have a contrasting color from the drawstrings 132, 134 and the polymeric film of the bag 100.

Oil based scent agents, as contemplated to be used in the invention, are known to migrate through polymeric films. Hence, scent from scent carriers 180, 182 will volatize outside bag 100 even with overlap area 142, 144 completely enclosed by polymeric film. However, it may be desirable to provide a certain amount of external ventilation for scent carriers 180, 182 encapsulated within overlap areas 142, 144 to increase the rate at which the scent is volatized externally from bag 100. In at least one embodiment, as shown by FIG. 5, scent carriers 180, 182, which may be comprised of the above-described scent ribbons, scent beads, or scented adhesive strips, may be ventilated by a plurality of slits 184. Slits 184 may be formed through the film of the folded-over portion of front and back panels 102, 104 or in the front and back panels 102, 104 so that scent carriers 180, 182 are ventilated to the exterior, the interior, or both the exterior and interior of bag 100. In at least one embodiment, the slits can extend generally between the hem seals 162, 164 and the lower seals 172, 174. Furthermore, the plurality of slits 184 may comprise only a pair of slits, may be limited to a single slit, or may comprise more than two per panel.

A further embodiment of the invention is illustrated by FIGS. 6*a* and 6*b*. In lieu of the slits as illustrated by FIG. 5, external ventilation of scent carriers 180, 182 may also be provided by a plurality of small circular ventilation apertures 186 defined in the overlap areas 142, 144 as shown by FIGS. 6*a* and 6*b*. FIG. 6*a* illustrates an embodiment where ventilation apertures 186 are dispersed between intermediate seal 176 and lower seal 174 and dispersed between first and second side edges 110, 112. Ventilation apertures may be formed in the film of bag 100 in the folded-over portions of front and back panels 102, 104 or in the front and back panels 102, 104 so that scent carriers 180, 182 are ventilated to the exterior, the interior, or both the exterior and interior of bag 100. The embodiment of FIG. 6*a* is only illustrated for front panel 102 since the structure of back panel 104 is merely duplicative of front panel 102.

In a further embodiment of the use of ventilation apertures 186, FIG. 6*b* shows ventilation apertures 186 arranged into one or more rectangular shaped regions and dispersed between the first and second side edges 110, 112 of bag 100. The quantity of rectangular shaped regions can vary from a single region to four or more. In at least one embodiment, a major axis of each rectangular region is oriented vertically. In another embodiment, each panel 102, 104 can have a pair of rectangular regions, with each region on a panel adjacent to a side edge 110, 112.

In at least one preferred embodiment of the invention illustrated by FIG. 6*b*, the location of the scent agent applied to scent carriers 180, 182 can be offset from the location of the rectangular shaped regions with ventilation apertures 186. The partial length of scent carrier 180 covered by and adjacent to a rectangular shaped region can be devoid of any scent agent while partial lengths of scent carrier 180 between rectangular shaped regions can have scent applied to one or more outer surfaces of scent carrier 180. An offset between each scent location and ventilation region can further prevent a user from coming into contact with the scent agent and facilitate a controlled release of the volatile scent agent from within the overlap area 142 of front panel 102. Although not shown, this arrangement can be mirrored for the overlap area 144 of back panel 104.

Ventilation apertures 186 of FIGS. 6*a* and 6*b* may be placed in panels 102, 104 such that the apertures are located in the interior or exterior of bag 100, or such that the apertures are located in both the interior and exterior. However, in at least one preferred embodiment, the ventilation apertures 186 are located only in the interior of bag 100. Ventilation apertures 186 may be formed generally as pinholes with each diameter within the range of 1/32 inch to 1/8 inch. The size and quantity of pinholes or ventilation apertures 186 can be varied to control the rate that the scent is released from bag 100.

FIG. 7 illustrates a further embodiment of the invention with ventilation apertures 186 placed in overlap areas 142, 144. As shown in FIG. 7, ventilation apertures 186 are provided in the embodiment of FIG. 4*c* with scented adhesive strips 180, 182. Ventilation apertures 186 are shown extending linearly from the first side edge 110 to the second side edge 112. A first line of a plurality of ventilation apertures 186 is shown between hem seal 162 and the top of scented adhesive strip 180. A second line of a plurality of ventilation apertures 186 is shown between the bottom of scented adhesive strip 180 and lower seal 172. The embodiment is only illustrated in FIG. 7 for the front panel 102 since the structure for back panel 104 is merely duplicative of the front panel 102.

In a further embodiment of the invention as shown by FIGS. 8*a* and 8*b*, a bag can be constructed with ribbons within overlap areas 142, 144, as previously described for FIG. 4*a*. However, ribbons 180, 182 may not be scented and may have a contrasting color from the color of drawstrings 132, 134 and the polymeric film of bag 100. In lieu of a scent agent applied to ribbons 180, 182, a scent agent can be applied on an interior of panels 102 and 104 as scent strips 188, 190. The scent agent may be a liquid and sprayed, rolled, injected, or brushed onto the interior of polymeric film of panels 102, 104. In one particular embodiment, the scent strips 188, 190 may be located on the interior of the panels 102, 104 approximately two-thirds of the bag length's away from the upper edge 120.

Rather than a liquid scent applied to an interior of the bag as scent strips 188, 190, a bead of a low melt polymer may be applied in the same location of scent strips 188, 190 as shown by FIGS. 8*a* and 8*b*. The low melt polymer may have a scent agent incorporated into it so that it volatizes when the bag is used and provides a pleasing fragrance to bag 100. In addition to a scent agent incorporated into it, the scent strips 188, 190 can have a contrasting color in relation to the drawstrings 132, 134 and the polymeric film of bag 100.

As previously noted, the specific embodiments depicted herein are not intended to limit the scope of the present invention. Indeed, it is contemplated that any number of different embodiments may be utilized without diverging from the spirit of the invention. Therefore, the appended claims are intended to more fully encompass the full scope of the present invention.

What is claimed is:

1. A thermoplastic bag comprising:

a front panel and a back panel defined in a web of thermoplastic film, the front panel and back panel joined at a bottom edge defined by a fold in the thermoplastic film, the front panel and back panel joined by a first side seal generally along a first side edge and by a second side seal generally along a second side edge, a front folded over upper portion of the front panel defining a first upper edge, the first upper edge defining an upper opening of the thermoplastic bag, the front folded over upper portion affixed to the front panel by a first lower seal adjacent to a distal edge of the front folded over upper portion, the first lower seal extending generally between the first side edge and the second side edge, a first drawstring between the front folded over upper portion and the front panel, the first drawstring between the first upper edge and above the first lower seal, the first drawstring extending generally between the first side edge and the second side edge, and a first scent adhesive between the front folded over upper portion and the front panel, the first scent adhesive below the first drawstring and above the first lower seal, the first scent adhesive between the first side edge and the second side edge, wherein the first scent adhesive is applied as a molten adhesive, the first scent adhesive having a scent agent dispersed throughout the molten adhesive.

2. The thermoplastic bag of claim 1 further comprising:

a first hem seal below the first drawstring and above the first scent adhesive, the first hem seal affixing the front folded over upper portion to the front panel.

3. The thermoplastic bag of claim 2 further comprising:

a first intermediate seal between the first hem seal and the first lower seal, the first intermediate seal between the first side edge and the second side edge.

4. The thermoplastic bag of claim 3 further comprising:

the first scent adhesive between the first intermediate seal and the first lower seal.

5. The thermoplastic bag of claim 3 further comprising:

the first scent adhesive between the first intermediate seal and the first hem seal.

6. The thermoplastic bag of claim 1 further comprising:

a plurality of ventilation apertures defined in and extending through the thermoplastic film, the plurality of ventilation apertures located between the first drawstring and the first lower seal.

7. The thermoplastic bag of claim 6 further comprising:

the plurality of ventilation apertures comprising a plurality of slits in the polymeric film.

8. A thermoplastic bag comprising:

a front panel and a back panel of thermoplastic film, the front panel and back panel joined at a bottom edge, the front panel and back panel joined generally along a first side edge and an opposing second side edge, a front folded over upper portion of the front panel defining a first upper edge, the first upper edge defining an upper opening of the thermoplastic bag, the front folded over upper portion affixed to the front panel by a first lower seal adjacent to a distal edge of the front folded over upper portion, the first lower seal extending generally between the first side edge and the second side edge, a first drawstring between the front folded over upper portion and the front panel, the first drawstring between the first upper edge and the first lower seal, the first drawstring extending between the first side edge and the second side edge, a first scent carrier between the front folded over upper portion and the front panel, the first scent carrier below the first drawstring and above the first lower seal, the first scent carrier extending between the first side edge and the second side edge, the first scent carrier attached to the front panel at the first and second side seals and not attached to the front panel between the first and second side seals, at least one surface of the first scent carrier coated with a liquid scent compound and a scented compound integrally incorporated into the first scent carrier.

9. The thermoplastic bag of claim 8 further comprising:

the first scent carrier a contrasting color from the first drawstring and the thermoplastic film of the thermoplastic bag.

10. The thermoplastic bag of claim 8 further comprising:

a first hem seal below the first drawstring and above the first scent carrier, the first hem seal affixing the front folded over upper portion to the front panel.

11. The thermoplastic bag of claim 10 further comprising:

a first intermediate seal between the first hem seal and the first lower seal, the first intermediate seal between the first side edge and the second side edge, and the first scent carrier between the first intermediate seal and the first lower seal.

12. The thermoplastic bag of claim 8 further comprising:

a plurality of ventilation apertures defined in and extending through the thermoplastic film of the thermoplastic bag, the plurality of ventilation apertures located between the first drawstring and the first lower seal.

13. The thermoplastic bag of claim 12 further comprising:

the plurality of ventilation apertures comprising a plurality of slits in the polymeric film.

14. A thermoplastic bag comprising:

a front panel and a back panel of thermoplastic film, the front and back panels joined at a bottom edge, the front and back panels joined adjacent to a first side edge and an opposing second side edge, a front folded over upper portion of the front panel defining a first upper edge, the first upper edge defining an upper opening of the thermoplastic bag, the front folded over upper portion affixed to the front panel by a first lower seal adjacent to a distal edge of the front folded over upper portion, the first lower seal extending between the first side edge and the second side edge, a first drawstring between the front folded over upper portion and the front panel, the first drawstring between the first upper edge and the first lower seal, the first drawstring extending between the first side edge and the second side edge, a first scent carrier between the front folded over upper portion and the front panel, the first scent carrier below the first drawstring and above the first lower seal, the first scent carrier extending between the first side edge and the second side edge, the first scent carrier attached to the front panel at the first and second side seals and not attached to the front panel between the first and second side seals, and a scented compound incorporated into the first scent carrier.

15. The thermoplastic bag of claim 14 further comprising:

a plurality of ventilation apertures defined in and extending through the thermoplastic film.

16. The thermoplastic bag of claim 15 further comprising:

the plurality of ventilation apertures located between the first drawstring and the first lower seal.

17. The thermoplastic bag of claim 14 further comprising:

a first hem seal below the first drawstring and above the first scent carrier, the first hem seal affixing the front folded over upper portion to the front panel.

18. The thermoplastic bag of claim 17 further comprising:

a first intermediate seal between the first hem seal and the first lower seal, the first intermediate seal between the first side edge and the second side edge.

19. The thermoplastic bag of claim 18 further comprising:

the first scent carrier between the first intermediate seal and the first hem seal.

* * * * *